US007066188B2

(12) United States Patent
MacNeil et al.

(10) Patent No.: US 7,066,188 B2
(45) Date of Patent: Jun. 27, 2006

(54) INTERIOR SEWER PIPELINE SCARIFYING APPARATUS

(75) Inventors: Gerard J. MacNeil, Surrey (CA); David B. MacNeil, Langley (CA); Gordon W. MacNeil, Delta (CA); Vernon G. Bose, Langley (CA)

(73) Assignee: Mac & Mac Hydrodemolition Inc. (CA)

( * ) Notice: Subject to any disclaimer, the term of this patent is extended or adjusted under 35 U.S.C. 154(b) by 394 days.

(21) Appl. No.: 10/429,790

(22) Filed: May 6, 2003

(65) Prior Publication Data

US 2003/0213509 A1 Nov. 20, 2003

Related U.S. Application Data

(63) Continuation-in-part of application No. 10/144,705, filed on May 15, 2002, now abandoned.

(51) Int. Cl.
*B08B 3/02* (2006.01)

(52) U.S. Cl. ..... 134/169 R; 134/168 R; 134/181; 239/750

(58) Field of Classification Search ..... 134/169 R, 134/168 R, 181; 451/76; 239/750, 264, 239/265

See application file for complete search history.

(56) References Cited

U.S. PATENT DOCUMENTS

| | | | | |
|---|---|---|---|---|
| 2,468,984 | A * | 5/1949 | Krieg et al. | 451/76 |
| 3,477,178 | A * | 11/1969 | Hulbert, Jr. | 451/2 |
| 3,581,441 | A * | 6/1971 | Hulbert, Jr. | 451/2 |
| 3,883,175 | A * | 5/1975 | Rodaway | 297/411.28 |
| 4,181,092 | A * | 1/1980 | Johnson | 118/72 |
| 4,205,694 | A * | 6/1980 | Thompson et al. | 134/181 |
| 4,210,098 | A * | 7/1980 | Harrison et al. | 118/317 |
| 4,568,013 | A * | 2/1986 | Morisot et al. | 228/45 |
| 4,911,188 | A * | 3/1990 | Seidel | 134/56 R |
| 5,203,646 | A * | 4/1993 | Landsberger et al. | 405/191 |
| 5,851,580 | A * | 12/1998 | Amberg et al. | 427/8 |
| 6,206,016 | B1 | 3/2001 | MacNeil et al. | |
| 2002/0179123 | A1 * | 12/2002 | Toward et al. | 134/34 |

FOREIGN PATENT DOCUMENTS

| | | |
|---|---|---|
| DE | 19806350 | 8/1999 |
| EP | 0395628 | 10/1990 |
| FR | 2720667 | 12/1995 |
| FR | 2744469 | 8/1997 |
| JP | 1-247583 | * 10/1989 |

OTHER PUBLICATIONS

European Patent Office 0 668 400, Feb. 1995.*

* cited by examiner

*Primary Examiner*—Frankie L. Stinson
(74) *Attorney, Agent, or Firm*—Clifford W. Vermette

(57) ABSTRACT

This application discloses an apparatus for scarifying the interior surface of a sewer pipe, which can remain in the sewer under active flow conditions. The apparatus includes at least one scarifying head, which may transverse back and forth along a rail assembly, which is configured to match the circumferential shape of the sewer pipe. The scarifying head includes a nozzle assembly and driving assembly. The nozzle assembly, located at the outer end of the scarifying head has nozzles. The nozzles emit jets of water under pressure to clean or scarify the interior surface of the pipe.

22 Claims, 8 Drawing Sheets

INTERIOR SEWER PIPELINE SCARIFYING APPARATUS

RELATED APPLICATIONS

This application is a continuation-in-part of U.S. patent application Ser. No. 10/144,705, filed May 15, 2002, and entitled INTERIOR SEWER PIPELINE SCARIFYING APPARATUS now abandoned.

FIELD OF INVENTION

The present invention relates to a device for cleaning the interior surface of a pipe and more specifically for cleaning the interior surface of a sewer pipe.

BACKGROUND OF THE INVENTION

Pipes used to carry liquids and gases commonly transport all types of materials including water, natural gas and liquid sewage. Over time, these pipes require servicing and cleaning. MacNeil et al. disclose an automated process for cleaning or restoring the inside of a pipe in U.S. Pat. No. 6,206,016. As yet, however, nobody has disclosed a device with an automated process for cleaning or restoring the inside of a pipe that can remain in the interior of the pipe, even under active flow conditions.

The interior surface of a pipeline carrying solids, liquids and gases generally degrades over time as the pipe walls interact chemically and physically with the substances flowing through them and air. In particular, a sewer system's interior walls corrode and deteriorate because corrosive materials contaminate the surface, degrading the metal and concrete used to build the sewer pipe. The corrosive material arises from both the sewage and waste water itself, and also from the digestible by-products of bacteria found in the sewage which proliferate in the anaerobic environment. The corrosion causes the walls of the sewer pipe to physically decay, eventually reducing their overall thickness.

The principle source of corrosion is sulfuric acid, which arises as a product of the reaction of sewer gases with water and air in the sewer pipe and the sewer environment itself. Various metal sulfates found in the sewage quickly convert into hydrogen sulfide by reducing to sulfide ions in the waste water, combining with hydrogen in water and outgassing above the liquid as hydrogen sulfide gas. Additional hydrogen sulfide originates from bacteria-containing contaminants which accumulate on the relatively rough concrete below the maximum liquid level. Bacteria found in these accumulations thrive in the anaerobic sewer environment producing hydrogen sulfide gas as a respiratory by-product. Oxygen from the liquid below and oxygen condensing from the water in the air react with the hydrogen sulfide on the pipeline walls creating the highly corrosive sulfuric acid. The sulfuric acid attacks the calcium hydroxide in the concrete sewer walls leaving calcium sulfates which ultimately crumble and fall off the interior of the wall substantially reducing its thickness.

The waste water level varies over the course of a 24-hour period. The flow is at its lowest level between 1:00 a.m. and 6:00 a.m. in the morning but it rises distinctly in the daytime when the pipe may operate near capacity. Because of the gaseous nature of the hydrogen sulfide, the pipe walls are predominately corroded in the portions of the wall above the minimum liquid level. Portions of the walls which are always below the water level are not subjected to such high concentrations of hydrogen sulfide gas or sulfuric acid and consequently do not experience the same level of decay.

Eventually the sewer walls must be restored or they can suffer permanent damage leading to great expense. The restoration process is a two-step operation that consists of first scarifying the interior pipe surface to remove the contaminants (including any possibly existing outer layers of corrupted concrete) from the surface of the pipe, i.e. a process herein defined as scarifying, and then applying a protective coating over the newly cleaned (scarified) pipe surface. Attempting to apply a protective coating without first scarifying the pipe surface is futile because it does not stop the decay that has already begun underneath the coating. Furthermore, the protective coating itself does not adhere well to the contaminated surface. Thus, scarifying is an essential element of the restoration process.

As previously mentioned, the sewer typically operates at high capacity during the day with a decreased flow overnight. In order to restore the sewer pipes without diverting the flow (a costly and sometimes impossible alternative), a bulk of the work must be done at night during the brief period when the flow is at a minimum. As previously outlined, the restoration process involves both scarifying the pipe surface and applying a protective coat. In practice, the rate of restoration is impaired because manual scarifying takes a proportionally greater amount of time than does the application of the protective coat. Automated scarifying processes exist, e.g. MacNeil et al above, however, presently devices require insertion into the sewer assembly and then removal from the sewer, all during the brief period when the sewer flow is at a minimum. Consequently, a need exists for an automated scarifying or restoration apparatus that can remain in the sewer during the period when the waste water level is not at a minimum.

SUMMARY OF THE INVENTION

The present invention relates to an apparatus for scarifying the interior surface of a sewer pipe. A rail assembly matching the circumferential shape of the sewer pipe interior is connected at its ends to a chassis moveable along the bottom half of the sewer pipe. For example, if the configuration of the sewer pipe is semicircular, or cylindrical with a false floor, preferably the rail assembly will be of an arcuate configuration. Preferably, the rail assembly of the present invention will be easily removed from the chassis to allow entry and removal of the apparatus through small openings, such as manholes, into the sewer.

At least one scarifying head is coupled to the rail assembly and may traverse in either direction along the rail assembly. The scarifying head comprises a nozzle assembly and a driving assembly. The nozzle assembly includes nozzles which rotate or oscillate, and emit a pressurized jet of fluid to scarify a circumferential swath of the interior surface of the sewer pipe.

The driving assembly enables the scarifying head to move along the rail assembly.

The scarifying head may be extendible to place the nozzles proximate the interior surface of the sewer pipe when the scarifying head is at rest or as it moves back and forth along the rail assembly.

The present invention may also include guide bars affixed to the chassis. The guide bars may have wall-engaging attachments, which move along the interior surface of the sewer pipe and maintain the orientation of the apparatus along a longitudinal axis of the pipe when the apparatus is in use.

An advantage of present invention is improved rates of scarifying of the sewer pipe's interior walls. A further advantage is assurance that the same intensity of scarifying is applied to the entire surface without the quality variation that is inherent in manual execution. Further still, the ability of the scarifying head to traverse in either direction of the rail assembly enables a circumferential swath of the interior surface of the sewer pipe to be scarified without requiring the apparatus to make several passes back and forth, resulting in a fast and cost-effective method of scarifying, and making restoration without diversion a cost-effective possibility.

Lastly, as the configuration of the apparatus enables it to remain in the sewer for the duration of the restoration (i.e. even when waste flow is not at a minimum), this feature results in an increase in productive working time for scarifying the interior surface of the sewer pipe when the sewer flow is at a minimum.

BRIEF DESCRIPTION OF THE DRAWINGS

Further features and advantages of the invention will be apparent from the following detailed description, given by way of example, of a preferred embodiment taken in conjunction with the accompanying drawings, wherein.

DETAILED DESCRIPTION OF THE INVENTION

Two embodiments envisaged in this invention are outlined below with reference to the drawings.

THE FIRST EMBODIMENT

Figure 1:
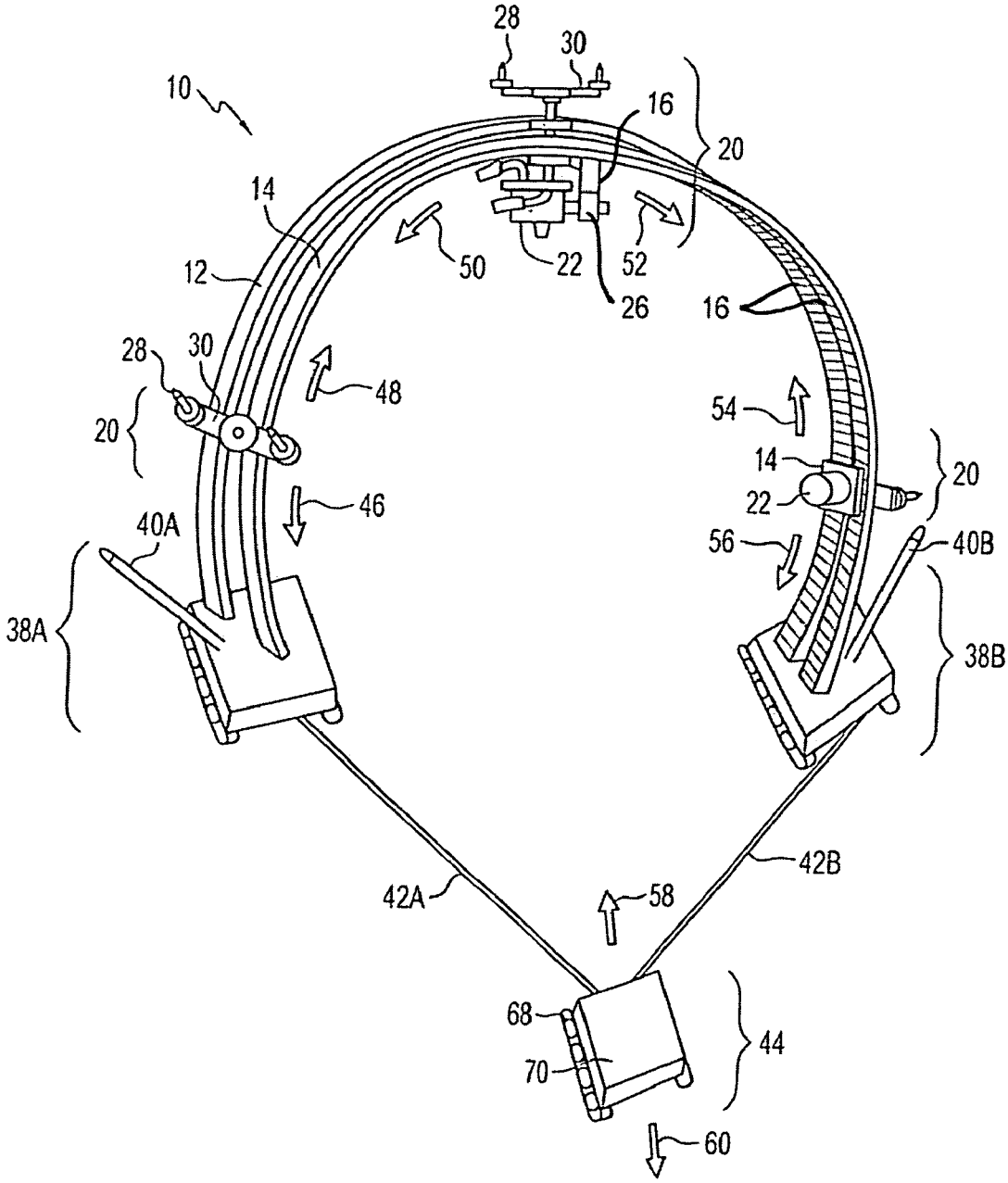
FIG. 1 is a perspective view of a first embodiment of the apparatus showing a vehicle, carts, rail assembly, and scarifying heads.
Figure 2:
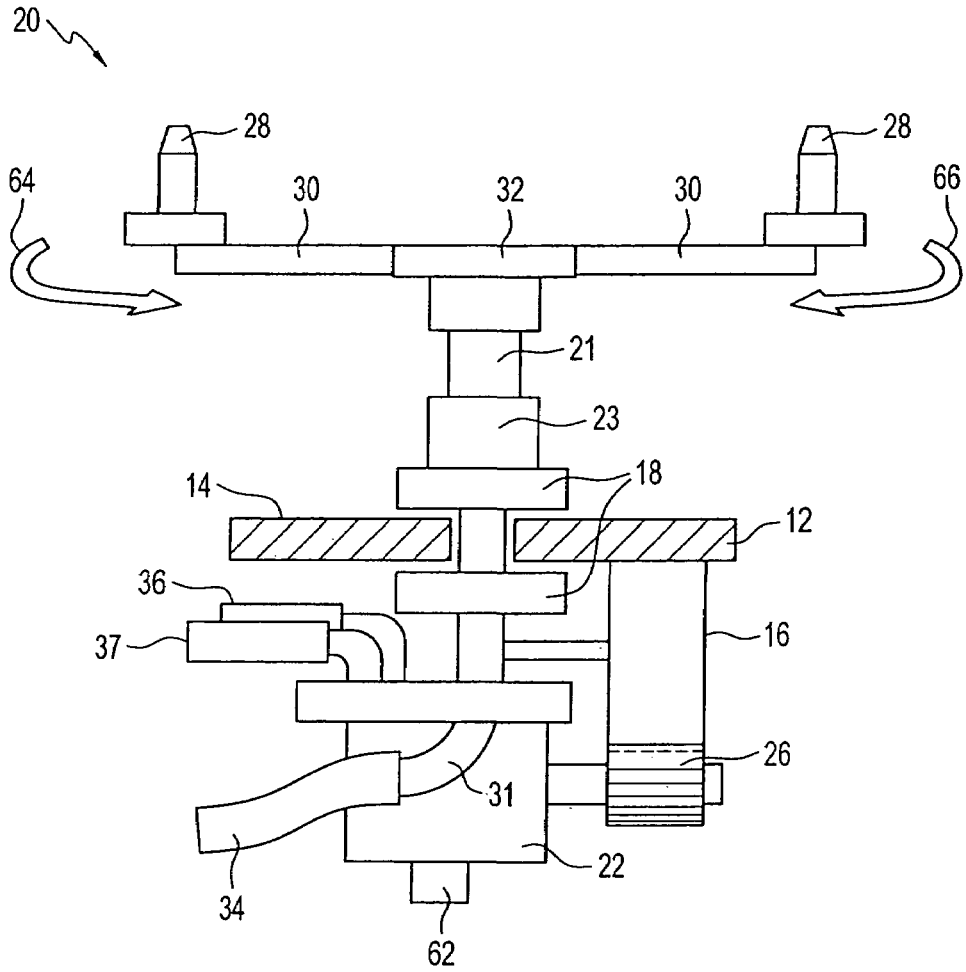
FIG. 2 is a front view of the scarifying head of the first embodiment.

Referring to FIGS. 1 and 2 a scarifying apparatus 10 includes at least one scarifying head 20 slidably mounted between two arcuate, spaced apart rails 12 and 14. The scarifying head 20 is mounted with a pair of low friction brackets or plates 18 slidably engaging the edges of the rails 12 and 14. A rack 16 is mounted on the underside of one of rails 12 and 14 and a small reversible hydraulic motor 22 mounted on the scarifying head 20 drives a pinion gear 26 which, in turn, engages the teeth of the rack 16, causing the scarifying head 20 to move along the rails 12 and 14. At an outer end of the scarifying head 20 is mounted a pair of outwardly directed nozzles 28 each connected to a respective branch 30, with each branch coupled to an exchanger 32 which receives a single stream of fluid and splits it into two streams of equal flow rate for each of the two nozzles 28. An inlet 31 at another end of the scarifying head 20 is engaged by a hose end 34 and conducts water to the exchanger 32. Inlet and outlet hydraulic hoses 36 and 37, respectfully attach to hydraulic couplings on the hydraulic motor 22.

The exchanger 32 is mounted at the distal end of a telescoping arm, which includes two telescoping pipes in which the upper portion of the pipe 21 has a smaller diameter such that it slides down the lower portion 23. A piston (not shown) controls the extension of the telescoping arm. Consequently, the scarifying head 20 can be manipulated so that the outwardly directed nozzles 28 can be positioned in close proximity to the pipe walls when the scarifying head 20 is at rest or as the scarifying head 20 moves back and forth along the rails 12 and 14.

One set of the ends of the rails 12 and 14 are affixed to a small cart 38A positioned at one side of the sewer pipe to be cleaned, while the other set of the ends of the rails 12 and 14 are affixed to another small cart 38B positioned on the other side of the sewer pipe to be cleaned. Each of carts 38A and 38B have mounted thereon a guide roller 40A and 40B which prevents the cart from scraping against the side of the sewer pipe when the apparatus 10 is in use.

Carts 38A and 38B are affixed by rigid rods 42A and 42B, respectively, to a small vehicle 44 powered by hydraulic motors (not shown) to move the rails 12 and 14 and carts 38A and 38B along the sewer pipe, while keeping the rails 12 and 14 transverse to the direction of travel. Although a hydraulic motor is used in this embodiment, any power providing means of both external or on-board types but preferably exhaustless may be used for this application. The direction of motion of the vehicle is that of arrow 58. However, in the event of movement in direction 60 is desired, an additional rigid rod 42C is connected to rods 42A and 42B as shown to keep the latter rods from moving towards each other.

Rails 12 and 14 can accommodate several scarifying heads 20 at the same time. Generally the scarifying heads 20 are positioned so that each travels back and forth along the rails 12 and 14 the same distance, with the net result being that together the scarifying heads 20 cover the entire circumference of the rails 12 and 14.

A controller 62 mounted adjacent to motor 22 receives a signal from a position sensor (not shown) which senses the position of the scarifying heads 20 and is responsive to command signals received from controller 62 to establish the trajectories of the scarifying heads 20 along the rails 12 and 14. For example, if three scarifying heads were used, each scarifying head 20 would usually be set to traverse approximately ⅓ of the circumference of the rails 12 and 14 by each traveling in one direction until the end of a respective path is reached and the opposite to cover the same path in an opposite direction.

As the scarifying head 20 moves along rails 12 and 14, water supplied under pressure through hose 34 flows into exchanger 32 and causes nozzles 28 and nozzle branches 30 to rotate. Arrows 64 and 66 in FIG. 2 indicate the direction of rotation of the nozzle assembly. Jets of water are emitted by the rotating nozzles 28 and impact on a surrounding interior surface of a sewer pipe (not shown). Typical water pressures used are in the range of 20,000 to 30,000 psi.

Vehicle 44 includes a chassis 70, a track assembly 68 and an on-board hydraulic motor (not shown). Although a track assembly 68 is shown in this embodiment, any actuator capable of moving the vehicle 44 under power from the hydraulic motor may be used. The hydraulic motor 22 is coupled by hydraulic hoses 36 and 37 that pass through a manhole (not shown) to an external hydraulic pump (not shown). An electrical cable from an external generator (not shown) also feeds through the manhole and couples electrical power to the vehicle 44. An on-board power supply converts this electrical power to low voltage DC for application to the various switches in response to commands from an on-board controller (not shown). The switches control the speed and direction of the vehicle 44. An on-board battery (not shown) can also power the electrical system which controls the speed and direction of the vehicle 44 as well as the movement of the scarifying heads 20. The hydraulic motor 22, switches, and on-board power supply are covered by protective boxes (not shown) to protect their sensitive parts from debris when the waste water level when is not at a minimum.

The vehicle 44 and carts 38A and 38B are outfitted with a drawbar (not shown) which holds the hoses away from the apparatus so that it may easily travel in either direction without running over the hoses. The drawbar may also hold the hoses close to the apparatus to enable debris to flow more easily through the sewer pipe when the apparatus is not in use.

An additional safety feature not shown in the drawings is a "deadman", which is a safety switch operative to cut off the high pressure from the moving parts of the apparatus. The deadman is useful in both emergency situations and when minor adjustments must be made to the apparatus during a job.

In order to reduce the size of the apparatus, the rails 12 and 14 may easily be removed from the carts 38A and 38B to enable the apparatus to enter small access opening into the sewer pipe. Once assembled, the configuration of the apparatus enables it to remain in the sewer pipe for the duration of the restoration.

The Second Embodiment

Figure 3:
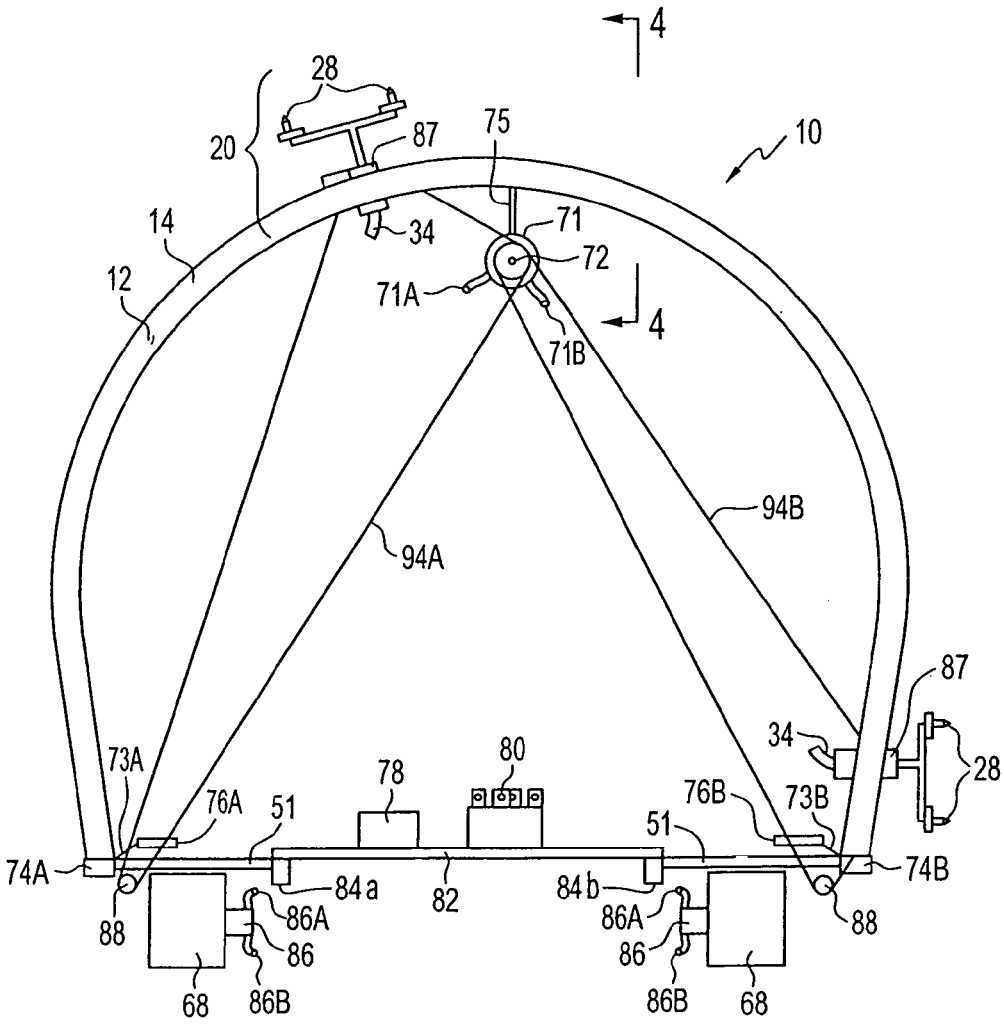
FIG. 3 is a front view of a second embodiment showing the configuration of the apparatus when it is in use.
Figure 4:
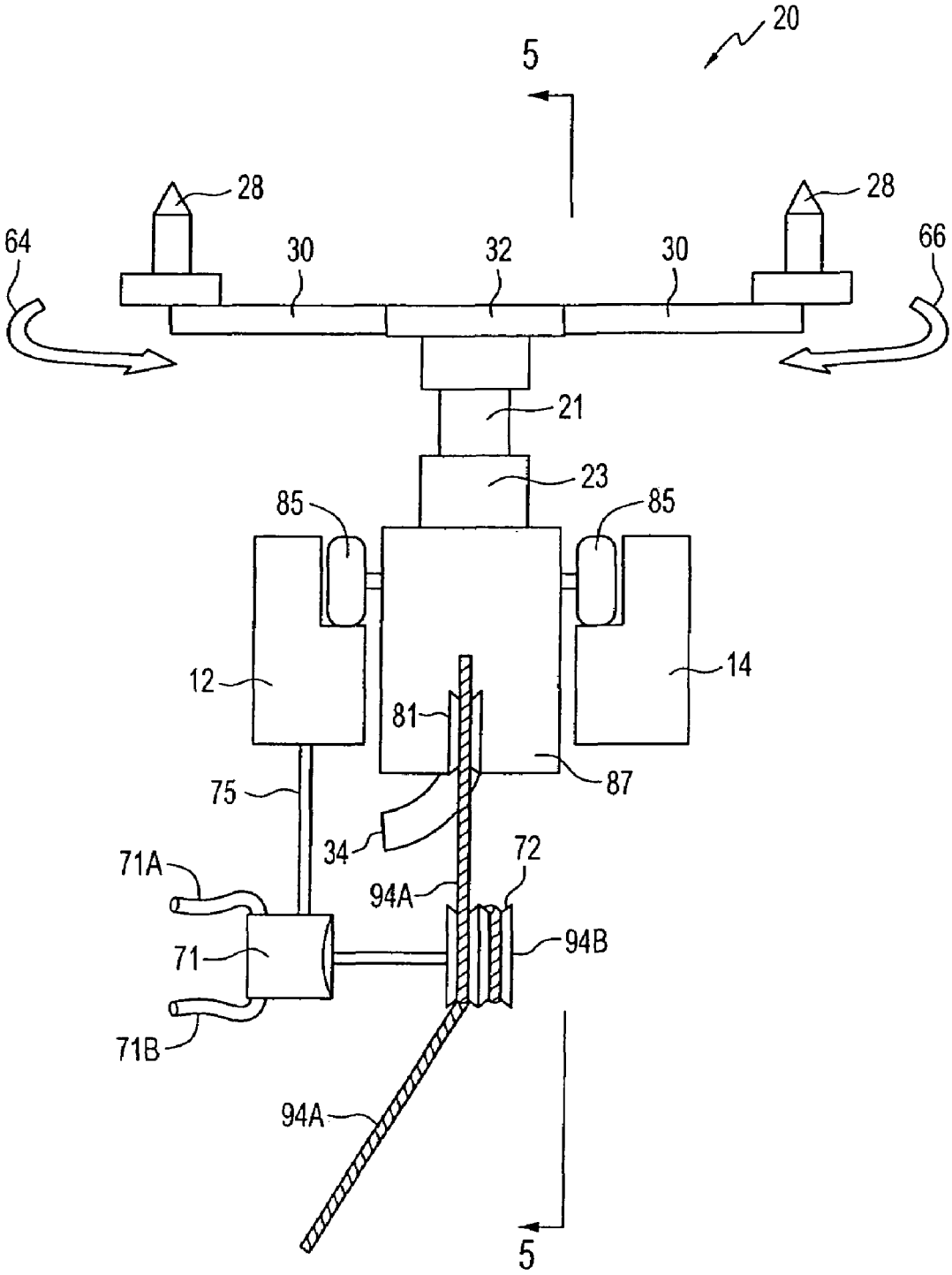
FIG. 4 is a sectional view along line 4—4 of FIG. 3.

Referring to FIGS. 3 and 4 a second embodiment of the scarifying apparatus 10 includes at least one scarifying head 20 slidably mounted between two arcuate, spaced apart rails 12 and 14. At an outer end of the scarifying head 20 is mounted a pair of outwardly directed nozzles 28 each connected to a corresponding branch 30, with each branch coupled to an exchanger 32 which receives a single stream of fluid and splits it into two streams of equal flow rate for each of the two nozzles. An inlet at another end of the scarifying head 20 is received by a hose end 34 and conducts water to the exchanger 32.

The exchanger 32 is mounted at the distal end of a telescoping arm, which includes two telescoping pipes in which the upper portion of the pipe 21 has a smaller diameter such that it slides down the lower portion 23. A piston (not shown) controls the extension of the telescoping arm. Consequently, the scarifying head 20 can be manipulated so that the outwardly directed nozzles 28 can be positioned in close proximity to the pipe walls when the scarifying head 20 is at rest or as the scarifying head 20 moves back and forth along the rails 12 and 14.

Figure 5:
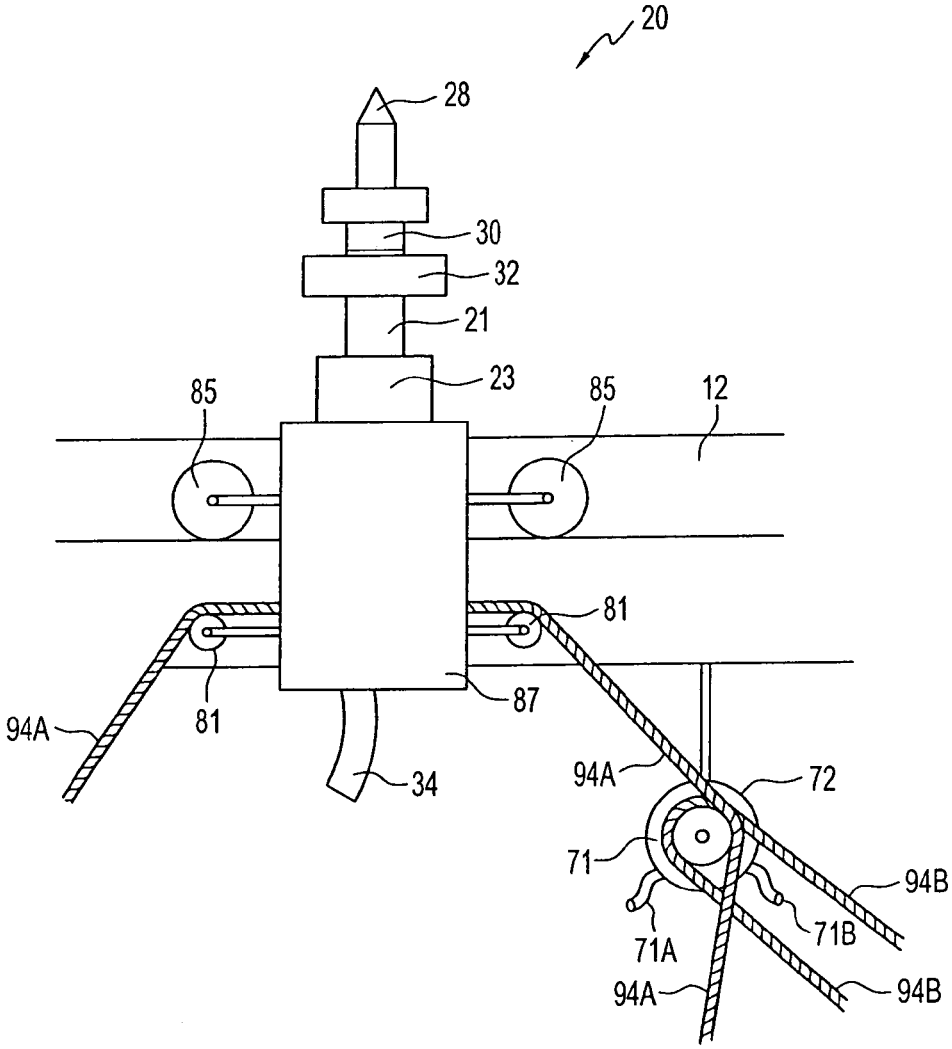
FIG. 5 is a sectional view along line 5—5 of FIG. 4.

However, in contrast to the first embodiment a pulley system is used to move the scarifying head 20 along the rails 12 and 14. Referring to FIGS. 3, 4, and 5 the pulley system is shown for a scarifying system having two scarifying heads 20. The ends of a fixed length of cable 94A and 94B are attached to either side of a carriage 87 of the scarifying head 20. To guide the ends of the cable, a sheave 81 is attached to each side of the carriage 87 just under the ends of the cable 94A and 94B. One side of the cable 94A and 94B is then lead around a motor controlled sheave 88 mounted to the chassis 51 of the track assembly 68, while the other side of cable 94A and 94B is guided over a motor controlled sheave 72 connected to a hydraulic motor 71. The hydraulic motor 71 is suspended from the rail assembly 12 by a rigid pole 75. The hydraulic motor 71 causes the motor controlled sheave 72 to rotate, which, in turn causes the cable 94A and 94B to move over the motor controlled sheave 72, and sheaves 88 and 81, which results in the scarifying heads 20 moving along the rails 12 and 14. Inlet and outlet hydraulic hoses 71A and 71B attach to hoses coupling on the hydraulic motor 71. Alternatively, a chain passing over the rim of the sheaves 72 and 81 may be used.

As the scarifying head 20 moves along rails 12 and 14, water supplied under pressure through hose 34 flows into exchanger 32 and causes nozzles 28 and nozzle branches 30 to rotate. Arrows 64 and 66 in FIG. 4 indicate the direction of rotation of the nozzle assembly. Jets of water are emitted by the rotating nozzles 28 and impact on a surrounding interior surface of a sewer pipe (not shown). Typical water pressures used are in the range of 20,000 to 30,000 psi.

One set of the ends of the rails 12 and 14 are affixed to socket 74A at one side of the track assembly 68, while the other set of the ends of the rails 12 and 14 are affixed to another socket 74B positioned on the other side of the track assembly 68. In order to reduce the size of the apparatus, the rails 12 and 14 may easily be removed from the sockets 74A and 74B to enable the apparatus to enter small access opening into the sewer pipe.

Figure 6:
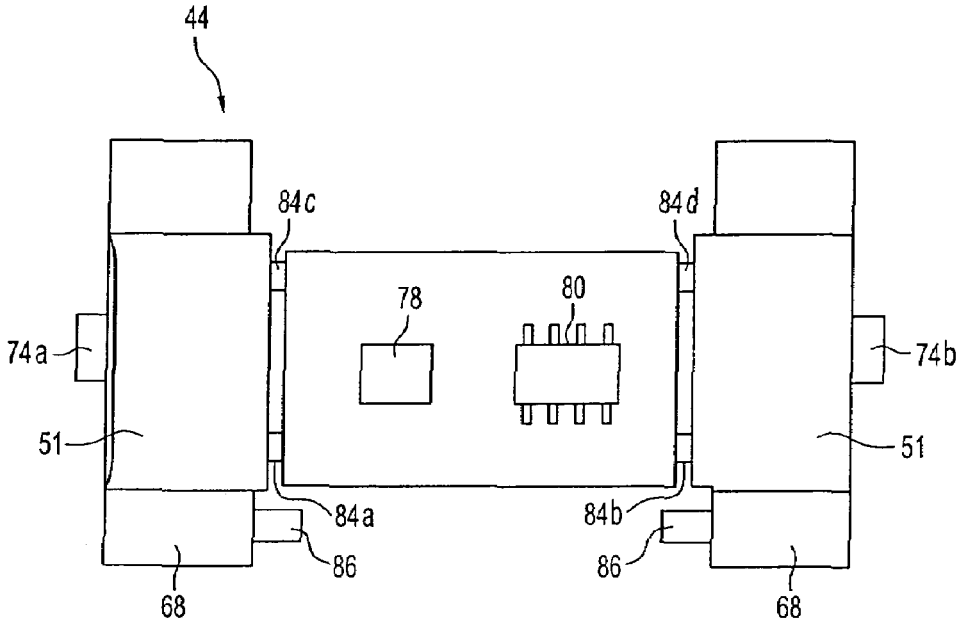
FIG. 6 is a top view of the second embodiment showing the track assembly and removable platform.

A platform 82 is located between the track assemblies 68 to keep the track assemblies transverse to the direction of travel. The track assemblies 68 are powered by hydraulic motors 86 to move the rails 12 and 14 along the sewer pipe. Inlet and outlet hydraulic hoses 86A and 86B attach to hoses coupling on the hydraulic motors 86. Although hydraulic motors 86 and 71 are used in this embodiment, any power providing means of both external or on-board types, but preferably exhaustless may be used for this application. A battery 78 and a hydraulic solenoid 80 are mounted on the platform 82. Referring to FIG. 6, the platform 82 may be removed from the chassis 51 of the track assemblies 68 by pins 84A, 84B, 84C, and 84D to protect the battery 78 and hydraulic solenoid 80, as well as to improve waste water flow through the sewer pipe when it is not at a minimum. Referring to FIG. 3, limit switches 76A and 76B are also removably mounted to the chassis 51 by pins 75A and 75B. The configuration of the apparatus enables the remaining portions of the apparatus to remain in the sewer pipe for the duration of the restoration.

The hydraulic motors 86 and 71 are coupled through hydraulic hoses to the hydraulic solenoid 80 and to an external hydraulic pump (not shown). The battery 70 powers the electrical system for application to the various switches. Alternately, an electrical cable from an external generator (not shown) may be used to couple electrical power to the scarifying apparatus 10. The limit switches 76A and 76B send signals to an on-board controller (not shown) coupled to the hydraulic solenoid 80 to cause the scarifying heads to change their speed and/or direction along the rails via the hydraulic motor 71. For example, if two scarifying heads were used, each scarifying head 20 would usually be set to traverse approximately ½ of the circumference of the rails 12 and 14 by each traveling in the same direction until one scarifying head 20 reached the end of a respective path where one of the limit switches 76A and 76B is located, and then reversing direction until signaled by the other limit switch 76A and 76B to change direction again. While the limit switches 76A and 76B control the direction of the scarifying heads 20, switches (not shown) also send signals to the on-board controller (not shown) to control the direction of the track assemblies 68 via the hydraulic solenoid 80.

An additional safety feature not shown in the drawings is a "deadman", which is a safety switch operative to cut off the high pressure from the moving parts of the apparatus. The deadman is useful in both emergency situations and when minor adjustments must be made to the apparatus during a job.

Figure 7:
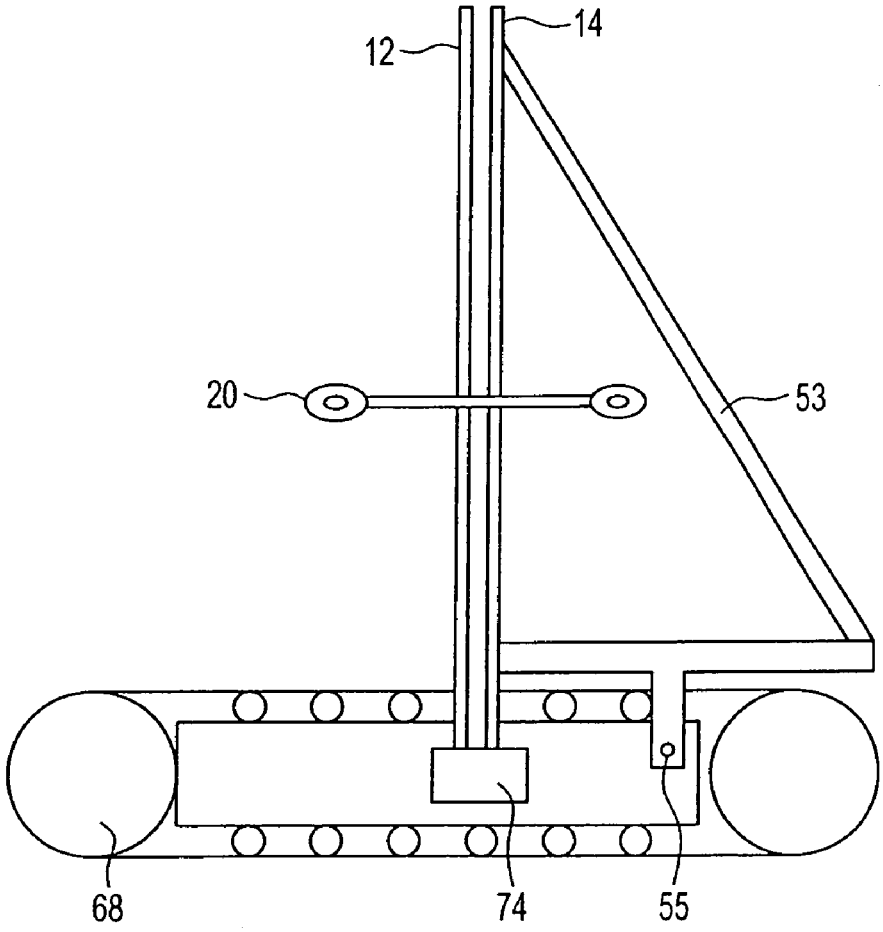
FIG. 7 is a side view of the track assembly and lateral support for the second embodiment.

Referring to FIG. 7 a lateral support 53 is attached to the rails 12 and 14 and chassis by a socket 55 on each side of the track assemblies 68. The lateral support may easily be removed from the rails 12 and 14 when the scarifying apparatus 10 is not in use.

Figure 8:
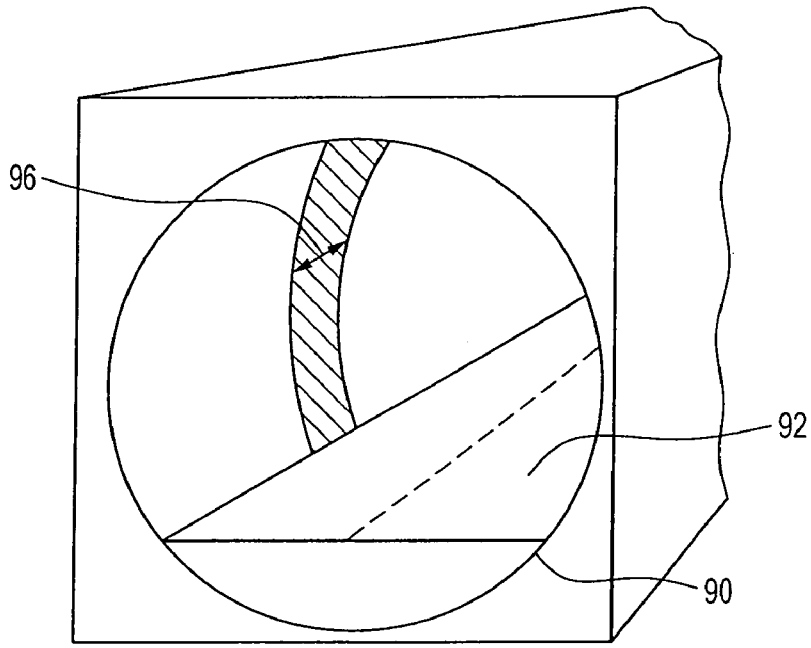
FIG. 8 is a perspective view of the interior of a cylindrical pipe depicting a circumferential swath scarified by a pass of the apparatus.

In the first and second embodiments an apparatus with an arcuate rail assembly will be preferred when the sewer pipe is a semicircular shape. However, referring to FIG. 8 the arcuate rail assembly may also be used in a cylindrical pipe by using a false floor 92 layered on top of the minimum flow mark 90. As the scarifying heads transverse back and forth along the rails, the apparatus can clean an entire circumferential swath in one pass. The circumferential swath is approximately the same width 96 as the diameter between the nozzles 28 which are coupled to the branches 30 of the scarifying head 20. As most of the corrosion occurs above the minimum flow mark 90, use of the false floor 92 is acceptable for restoration applications.

Alternatively, if the sewer pipe is another shape, such as rectangular, the rails of the apparatus may be configured to match the shape of the pipe. Further, the rail assembly may consist of only one rail with a slot to which the scarifying head 20 may be coupled.

While the nozzle assembly in the above description is described as rotating, it may instead oscillate or both rotate and oscillate.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to the description. It is therefore contemplated that the appended claims will cover any such modifications or embodiments as fall within the true scope of the invention.

What is claimed is:

1. An apparatus for scarifying an interior surface of a sewer pipe, comprising:

(a) a support assembly moveable along an interior of said sewer pipe supported from a bottom half thereof;

(b) a rail assembly supported on its ends by said support assembly juxtaposed to the interior surface of said sewer pipe, said rail assembly matching a circumferential trajectory of said sewer pipe;

(c) at least one scarifying head coupled to and moveable in either direction along said rail assembly, said scarifying head comprising;

(i) a nozzle assembly coupled to said scarifying head having at least one nozzle, operative to rotate or oscillate and emit a jet of fluid against the interior surface of said sewer pipe and to scarify the interior surface of said sewer pipe; and (ii) a driving assembly coupled to said scarifying head, operative to drive said scarifying head along said rail assembly over a pre-selected trajectory.

2. The apparatus according to claim 1, wherein said support assembly is a pair of carts.

3. The apparatus according to claim 2, wherein said pair of carts is coupled to a vehicle, said vehicle moveable along said interior of said sewer pipe.

4. The apparatus according to claim 3, wherein said vehicle is supported and propelled by a pair of spaced apart tracks.

5. The apparatus according to claim 2, wherein said pair of carts are each supported and propelled by a pair of spaced apart tracks.

6. The apparatus according to claim 1, wherein said support assembly is a single vehicle.

7. The apparatus according to claim 6, wherein said single vehicle is supported and propelled by a pair of spaced apart tracks.

8. The apparatus according to claim 1, wherein said nozzle assembly further comprises:

(a) an exchanger coupled to an external source of fluid;

(b) a plurality of branches coupled to and radially spaced around said exchanger; and (c) a distal end on each branch of said plurality of branches having said at least one nozzle.

9. The apparatus according to claim 8, wherein said external source of fluid is a pressurized fluid source remote from said sewer pipe.

10. The apparatus according to claim 1, wherein said rail assembly further comprises a rack having gears located on an underside of said rail assembly.

11. The apparatus according to claim 10, wherein said driving assembly drives said scarifying head back and forth along said pre-selected trajectory.

12. The apparatus according to claim 1, wherein said rail assembly further includes two recessed edges located on opposing inner sides of said rail assembly.

13. The apparatus according to claim 12, wherein said driving assembly further comprises:

(a) a carriage having a first side substantially perpendicular to said rail assembly and a second side, opposite said first side and substantially perpendicular to said rail assembly;

(b) at least one roller coupled to said carriage between said first and second sides, said at least one roller operative to engage said recessed edge;

(c) a first upper sheave coupled to said first side of said carriage and a second upper sheave coupled to said second side of said carriage;

(d) a lower sheave coupled to said support assembly;

(e) an intermediate sheave coupled to said rail assembly;

(f) a cable coupled to said first side of said carriage, and passing over said first upper sheave, said lower sheave, said intermediate sheave, said second upper sheave and coupled to said second side of said carriage; and (g) a motor coupled to and operative to rotate said intermediate sheave;

wherein rotating said intermediate sheave in a first direction draws the cable to move said scarifying head in a first direction, and rotating said intermediate sheave in a second direction draws the cable to move said scarifying in a second direction opposite said first direction.

14. The apparatus according to claim 1, wherein said support assembly moves incrementally as said apparatus operates.

15. The apparatus according to claim 1, wherein said apparatus scarifies a circumferential swath perpendicular to a direction of travel of said support assembly.

16. The apparatus according to claim 1, wherein said rail assembly is readily detachable from said support assembly to enable said support assembly to pass through an access opening into said sewer pipe.

17. The apparatus according to claim 1, wherein said apparatus is configured to enable said apparatus to permanently remain in said sewer pipe.

18. The apparatus according to claim 1, including one or more extendible guide bars extending out from said support assembly, and having a wall engaging attachment at a distal end thereof, each of said one or more guide bars operative to move along an interior surface of said sewer pipe and maintain orientation of said apparatus along a longitudinal axis of said sewer pipe.

19. The apparatus according to claim 1, wherein said apparatus includes three scarifying heads spaced apart along said rail assembly such that each of said scarifying heads transverses along ⅓ of said rail assembly, each scarifying head operative to scarify a corresponding region of said interior surface of said sewer pipe.

20. The apparatus according to claim 1, wherein said rail assembly is arcuate.

21. The apparatus according to claim 1, wherein said bottom half thereof is a false floor mounted within said sewer pipe.

22. The apparatus according to claim 1, wherein said scarifying head is reversibly extendible to place said at least one nozzle proximate said interior surface of said sewer pipe when said scarifying head is either at rest or moving over said pre-selected trajectory.

* * * * *